US006286693B1

(12) United States Patent
Brown

(10) Patent No.: US 6,286,693 B1
(45) Date of Patent: Sep. 11, 2001

(54) RACK SUPPORT SYSTEM FOR PLASTIC PALLETS

(75) Inventor: Henry F. Brown, Portage, WI (US)

(73) Assignee: Alltrista Corporation, Indianapolis, IN (US)

( * ) Notice: Subject to any disclaimer, the term of this patent is extended or adjusted under 35 U.S.C. 154(b) by 0 days.

(21) Appl. No.: 09/347,597

(22) Filed: Jul. 1, 1999

(51) Int. Cl.[7] ..... A47F 5/14

(52) U.S. Cl. ..... 211/181.1; 211/191

(58) Field of Search ..... 211/181.1, 189, 211/186, 191, 187

(56) References Cited

U.S. PATENT DOCUMENTS

| | | | | |
|---|---|---|---|---|
| D. 418,342 | * | 1/2000 | Von Gunten et al. | D6/511 |
| 2,455,197 | | 11/1948 | Sullivan . | |
| 2,463,588 | | 3/1949 | Arthur . | |
| 2,815,130 | | 12/1957 | Franks . | |
| 2,918,176 | | 12/1959 | Bell et al. . | |
| 3,027,016 | * | 3/1962 | Becht | 211/153 |
| 3,042,221 | | 7/1962 | Rasmussen . | |
| 3,086,660 | | 4/1963 | Steele . | |
| 3,294,351 | * | 12/1966 | Rollins, Jr. | 248/243 |
| 3,545,626 | * | 12/1970 | Seiz | 211/176 |
| 3,756,167 | | 9/1973 | Wilson . | |
| 3,826,205 | * | 7/1974 | Weiss | 108/51 |
| 3,858,530 | * | 1/1975 | Jaffee et al. | 108/156 X |
| 4,331,243 | * | 5/1982 | Doll | 211/49 D |
| 4,470,584 | * | 9/1984 | Mizelle | 267/103 |
| 4,485,744 | * | 12/1984 | Umemura et al. | 108/51.1 |
| 4,506,607 | * | 3/1985 | Jacoby | 108/60 |
| 4,533,056 | * | 8/1985 | Krikorian | 211/186 X |
| 4,703,702 | | 11/1987 | Speicher . | |
| 4,729,483 | * | 3/1988 | Schrader | 211/187 X |
| 4,955,490 | | 9/1990 | Schäfer . | |

(List continued on next page.)

OTHER PUBLICATIONS

"How Do You Improve on Great Product . . . ".

"Guidelines on how to determine your requirement and order decking . . . ".

"Sigmadeck Wire mesh decks for pallet racks" Sigma Industries, Inc.

"Sigmadeck for Palletracks"—Sigma Industries, Inc., P.O. Box 288, 120 Willow St., Springport, MI 49284.

"Selective Rack Accessories".

*Primary Examiner*—Daniel P. Stodola
*Assistant Examiner*—Khoa Tran
(74) *Attorney, Agent, or Firm*—Lathrop & Clark LLP

(57) ABSTRACT

A metal deck is received on the front and rear beams of a conventional rack system and is specially configured to receive a conventional nine leg plastic pallet. Weight and cost efficiency in the deck is achieved by concentrating the deck mass in those segments of the deck which make contact with the legs of the plastic pallet, and more particularly by recognizing that the center row of pallet legs carries a greater fraction of the pallet load then each of the outside rows of pallet legs. Closely spaced parallel front to back wire sections define pallet leg row support segments for the three rows of posts or legs of a plastic pallet, distributing the load of each leg over multiple wire segments. Front to back wires with an upwardly opening v-section are connected by struts to the wires within each support segment. Thus a single truss is formed as a part of each side support segment, and two trusses are formed as a part of the center support segment. A wire is fixed to the front of the deck support segments to serve as a quake stop or restraint against supported pallets moving in response to tremors. Hooks and downwardly extending front and rear structure retain the deck on a rack, while wires are bent upwardly and connected to define side stops and a rear stop which restrain the pallet legs on the deck. The deck support segments may be formed as stamped or roll-formed segments of steel sheet.

16 Claims, 5 Drawing Sheets

U.S. PATENT DOCUMENTS

| | | | | |
|---|---|---|---|---|
| 4,964,350 | | 10/1990 | Kolvites et al. . | |
| 5,042,396 | | 8/1991 | Shuert . | |
| 5,052,307 | * | 10/1991 | Morrison | 108/53.1 |
| 5,069,338 | | 12/1991 | Grigsby . | |
| 5,220,980 | | 6/1993 | Petter . | |
| 5,255,930 | * | 10/1993 | Jones et al. | 280/33.992 |
| 5,460,103 | * | 10/1995 | Dunn et al. | 108/51.1 |
| 5,573,124 | * | 11/1996 | Frost | 211/181 |
| 5,588,371 | | 12/1996 | Looker . | |
| 5,809,907 | * | 9/1998 | Bumgarner | 108/51.11 |
| 5,868,080 | | 2/1999 | Wyler et al. . | |
| 5,996,508 | * | 12/1999 | Constantino et al. | 108/51.1 |
| 6,042,322 | * | 3/2000 | Piccini | 414/281 |

* cited by examiner

RACK SUPPORT SYSTEM FOR PLASTIC PALLETS

CROSS REFERENCES TO RELATED APPLICATION

STATEMENT AS TO RIGHTS TO INVENTION MADE UNDER FEDERALLY SPONSORED RESEARCH AND DEVELOPMENT

BACKGROUND OF THE INVENTION

The present invention relates to structures for supporting palletys in general, and to rack systems which receive plastic pallets in particular.

The second half of the 20th century has seen the widespread use of pallets for the effective and economical storage and transport of goods and commodities of all kinds. Palletized material handling means that goods are handled not as distinct custom loads, but as repeatable elements in a streamlined flow. The tremendous economic advantage to handling material on pallets, as opposed to specialized containers, has supported an enormous investment throughout the world in standardized material handling equipment including hand trucks, forklift vehicles, and rack storage systems. For decades, the wooden pallet assembled from hardwood planks and steel nails has been the world standard. Much of the support infrastructure has been configured to accommodate the attributes of a hardwood pallet. Pallet handling equipment and pallet supports are tailored to the rigidity, maximum deflection, and strength of a wooden pallet.

Nevertheless, despite the widespread acceptance of wooden pallets there is also a growing acknowledgment of the inadequacies of wood in today's demanding pallet environment. Pallets made of plastic are splinter and rust free, resistant to rot, uniform, nestable, easily adapted to custom cargoes, and have a greatly extended useful life when compared to wooden pallets. Even with these many benefits, there are certain attributes of plastic which cannot be overlooked. First, if the plastic is to be resilient enough to withstand the rough treatment of commercial transportation, it will be of lower strength and rigidity than wood. Second, plastic by weight is usually more costly than wood.

By the use of reinforcements and thoughtful engineering, a plastic pallet can be designed to equal the performance of a wooden pallet in terms of maximum deflection, load carrying capability, and length of unsupported span. However, a pallet requiring significant additional material comes at a measurable increase in cost. When the vast scale of local, national, and international material flows is taken into account, with their large inventories of pallets, the cost of conversion can be daunting.

A pallet is subjected to a variety of different loading conditions at different stages in the transportation system. At rest, all the pallet legs are disposed on a planar floor or an underlying load. In transport, the pallet deck supports the loads on the tines of a lift truck. A particularly demanding loading condition is rack support in which the outer legs of the pallet carry the full load. Wooden timbers perform very well when crossing an open span. To match this performance a plastic pallet will typically require reinforcement with metal or other material, with a significant increase in pallet cost.

Numerous warehouses throughout the country are outfitted with pallet supporting rack systems having thousands of positions to receive loaded pallets. These rack systems are generally configured to receive wooden pallets, and represent an enormous investment in infrastructure. These rack systems typically have front and rear beams which support the pallet in a clear span. Metal mesh decks are available which extend between the rack front and rear beams and which support smaller or less stiff loads. However, these mesh decks are usually uniform arrays of rods or wires and not particularly adapted to minimizing deflection. Moreover, the plastic pallet can be marred or deformed if too great a load is carried on a single wire. Rather than utilize costly reinforced plastic pallets which can be employed with historic rack systems, low cost pallets could be used if a rack support system were available which did not impose such challenging demands on the pallet. An additional benefit is the purchaser of the rack deck maintains control over the investment, and it will far outlast the life of any particular pallet. If a deck could be supplied which permitted the use of lower cost pallets, and which could be acquired for about the cost differential between a plastic pallet of rigidity similar to wood, and one which is not, the conversion to widespread use of the advantageous plastic pallets would be greatly facilitated.

What is needed is an economical deck which can be retrofitted to conventional rack systems to support conventional plastic pallets to provide a cost-effective plastic pallet storage system.

SUMMARY OF THE INVENTION

The plastic pallet support deck of this invention is a metal structure received on the front and rear beams of conventional rack systems. The deck is specially configured to receive a conventional four-way entry nine leg plastic pallet, and will also accept a conventional wood pallet. Weight and cost efficiency in the deck is achieved by concentrating the deck mass in those segments of the deck which make contact with the legs of the plastic pallet, and more particularly by recognizing that the center row of pallet legs carries a greater fraction of the pallet load then each of the outside rows of pallet legs. The deck may be formed of steel wire, with closely spaced parallel front to back wire sections defining pallet leg row segments specifically to support the three rows of legs in a plastic pallet. The close spacing of the wires distributes the load of a pallet leg over multiple wires, reducing the point forces tending to deform the leg plastic. Front to back wires with an upwardly opening v-section are connected by struts to the wires within each support segment. Thus a single truss is formed as a part of each side support segment, and two trusses are formed as a part of the center support segment. Hooks extend downwardly and rearwardly from the front of the deck which are engagable beneath or within the front beam of a rack. A single wire is fixed to the front of the deck to project upwardly from the three support segments to serve as a quake stop or restraint against supported pallets moving in response to external forces. A front lip restrains rearward movement of the deck and downwardly bent wires at the rear of the deck prevent frontward movement. Sections of the wires forming the support surface of the deck are bent upwardly and connected to define side stops and a rear stop which restrain the pallet legs on the deck. The deck support segments may also be formed as stamped or roll-formed segments of steel sheet and still present some or all of the aforementioned features.

It is an object of the present invention to provide an economical deck for efficiently supporting the loads imposed by a supported plastic pallet.

It is also an object of the present invention to provide a deck specially configured to support a plastic pallet having four way entry.

It is another object of the present invention to provide a structure for retrofitting conventional rack assemblies intended for wooden pallets to accept plastic pallets.

It is also an object of the present invention to provide a pallet support rack with structure which restrains the escape of a supported pallet.

It is yet another object of the present invention to provide a pallet support deck for a rack system which is resistant to unintended removal from the supporting rack structure.

It is still another object of the present invention to provide a pallet support deck which retains plastic pallets thereon despite minor earth tremors, or unintentional contact with equipment.

It is a further object of the present invention to provide a pallet support deck which does not significantly deface or mar the supported plastic pallet.

It is an additional object of the present invention to provide a pallet support deck for a pallet rack which accommodates low cost plastic pallet, as well as wooden pallets of conventional design.

Further objects, features and advantages of the invention will be apparent from the following detailed description when taken in conjunction with the accompanying drawings.

DESCRIPTION OF THE PREFERRED EMBODIMENTS

Figure 1:
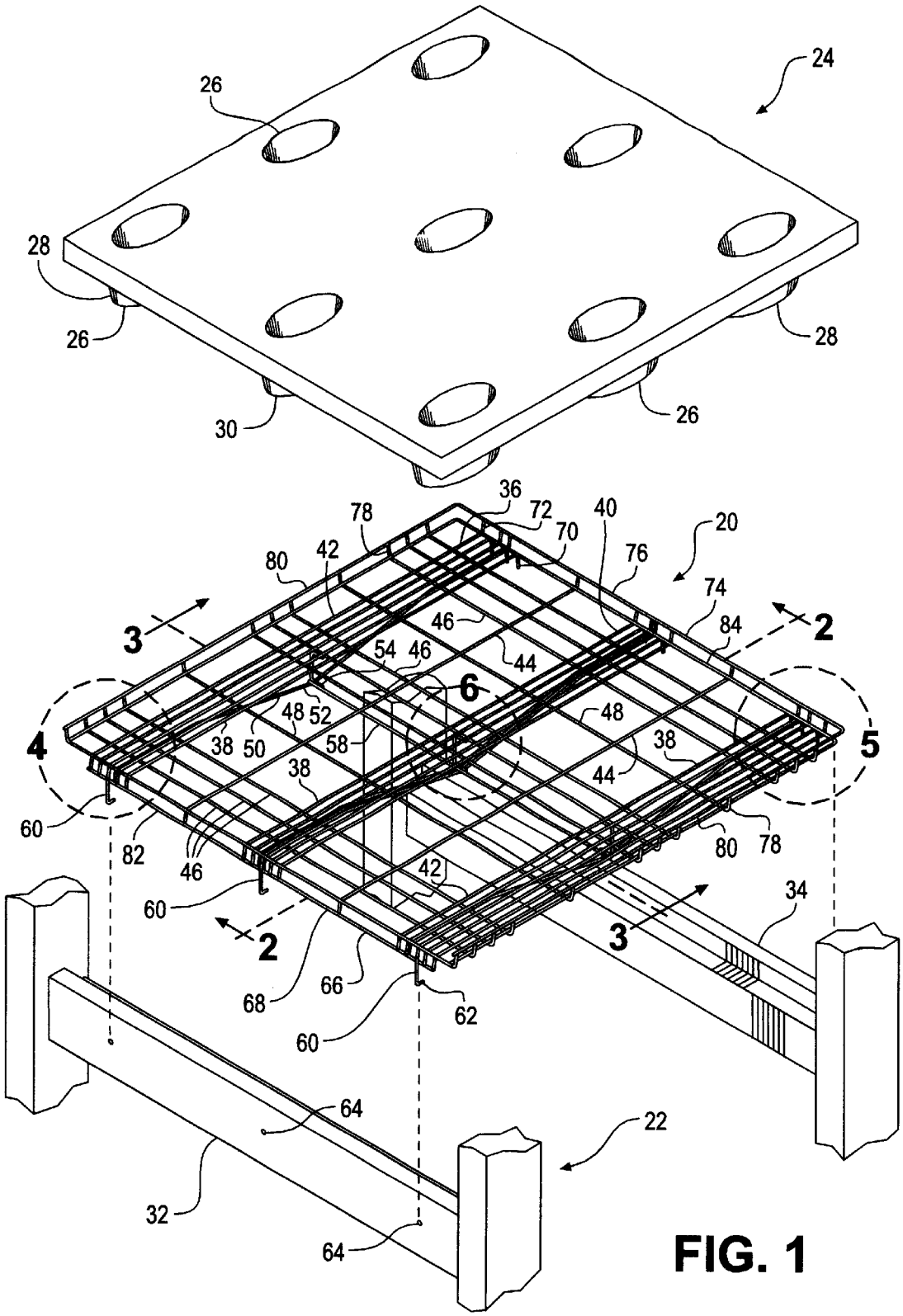
FIG. 1 is an isometric view of the support deck of this invention shown in exploded relationship to a rack structure and a conventional pallet.

Referring more particularly to FIGS. 1–7 wherein like numbers refer to similar parts, a pallet deck 20 of this invention is shown in FIG. 1 in relation to a rack 22 and a conventional nine-leg plastic pallet 24. Pallets designed to be widely used must share certain dimensions in order to be accommodated by conventional lift trucks and rack systems. A common and economical plastic pallet has nine legs 26, positioned in three rows of three legs, and permitting four-way entry beneath the pallet. The spacing between the outermost legs on the side of a pallet into which the forklift tines will enter is about 27 inches. The deck 20 will also, however, accommodate a two way entry pallet, which has three front-to-back extending legs or leg rows. Other common plastic pallets with different bottom treatments such as front to back runners connected beneath the legs in a row, or a lower deck connected to all nine legs or posts can also be accommodated on the deck 20. Basic pallet dimensions will be evidenced by plastic pallets from a variety of manufacturers, be they of the type manufactured by TriEnda Corporation of Portage, Wis., and disclosed in U.S. Pat. No. 5,566,624, the disclosure of which is incorporated by reference herein, or those of some other manufacturer.

To minimize the width of any ledges cantilevered outwardly from a leg, the outside legs of a pallet are positioned close to the exterior perimeter of the pallet. An analysis of the loads carried by the nine-leg pallet will show that the corner legs bear the least load, while the center leg bears the most, as much as twice the load of a corner leg. The legs 26 of a nine-leg pallet may be grouped into three rows: two side rows 28, and one center row 30 between the side rows. Generally, the center row 30 will bear about fifty percent of the total load of the pallet, while each side row 28 will bear about twenty-five percent of the total.

Many modern product distribution systems rely on central or regional warehouses or distribution centers, which serve as hubs for the dissemination of products throughout the country. Loads of goods may be stored on pallets in these distribution centers on modular steel racks, such as the rack 22 shown in FIG. 1. Each distribution center has an extensive installation of racks, providing side by side and vertical storage of pallets. A single distribution center may have from 10,000 to 100,000 pallet positions. The conversion of a distribution center rack system to accommodate plastic pallets can thus be seen as a significant investment of resources. The tremendous number of pallet positions to be addressed makes it imperative that materials be used at utmost efficiency.

The deck 20 is constructed of steel, an extremely durable and high strength material. Nonetheless, every pound of steel required for a deck 20 adds cost to the structure, and that cost will be multiplied many thousands of times for each installation. The quantity of steel required for each deck 20 is mis by configuring the deck for one type of load-that imposed by the legs of a plastic pallet. The design of the deck obtains the specialized configuration by taking into account first, that there is contact between the pallet and the deck only along the three rows of pallet legs, and second, that the loads imposed along the center row are greater than the loads along the side rows of legs.

As shown in FIG. 1, the deck 20 is composed of an array of steel rods or wires, which may be about ⅛ to ¼ inch in diameter. The deck 20 is dimensioned to extend between a front beam 32 and a rear beam 34 of a conventional rack 22. The deck 20 conveys all the loads of the supported pallet to the rack front and rear beams 32, 34. The deck has a top surface 36 defined by wires which run from front to back and perpendicular wires which run from side to side. The wires are not, however, uniformly spaced in either direction. Groups of five closely spaced front to back wires 38 define a center row support segment 40 and two side row support segments 42. The front to back wires 38 are spaced apart in the side to side direction only about ½ inch, with the result that the pallet leg disposed on a support segment 40, 42 will engage most or all of the front to back wires of the segment, spreading the load out over multiple wires, and reducing the possibility that the stiff steel wires will dent the more resilient plastic of the pallet leg. The plastic from which a pallet is composed is very susceptible to permanent deformation if too great a load is applied over a small area. By positioning multiple wires beneath each leg, the pallet load is distributed over a greater area, and the tendency to create a groove in the underside of the pallet leg is reduced. This tendency can be reduced further by employing square, rectangular or flattened wires or metal strips.

To contribute to the overall stiffness of the deck 20, an intermediate front to back wire 44 may be positioned between the center row support segment 40 and each side row support segment 42. A group of three closely spaced side to side wires 46 extend underneath the front to back wires of each row support segment. There are three sets of three side to side wires 46, such that each position to be occupied by a pallet leg will have a grid of closely spaced criss-crossing wires. Again for overall deck stiffness, an intermediate side to side wire 48 is positioned between the center group of side to side wires and the front and back groups.

Because the front of the deck 20 and the rear of the deck rest directly on the front and rear support beams 32, 34 the greatest moments will be experienced at the leg positions intermediate between the front and rear beams. To provide additional stiffniess at these interior leg positions, front to back wires 50 with downwardly extending upwardly opening v-sections 52 are positioned within each row support segment, and are connected by C-shaped struts 54 to the front to back wires which define the top surface of each row support segment. As shown in FIG. 1, a single wire 50 with v-section 52 may be provided as part of each side row support segment 42, while two such wires 50 with v-sections 52 are provided in the center row support segment 40.

The center row segment calls for greater stiffening, as the center row support is segment will experience approximately twice the loads of a side row support segment. The wires 50 with v-sections 52 and the struts 54 form trusses 56 with the front to back wires 38 to which they are connected. Lateral stifffiess is provided to the three trusses 56 by a side to side wire 58, shown in FIG. 6, which extends between and connects the three struts 54. It will be noted that the wires 50 having the v-sections continue in the same plane as the other front to back wires for at least about six inches adjacent the front and the rear of the deck. Thus the deck 20 does not have any downwardly extending structure which would interfere with the front beam 32 or the rear beam 34 of the rack 22, or with any side-to-side members which may be placed adjacent the inwardly facing recesses defined by the beams 32, 34.

Figure 2:
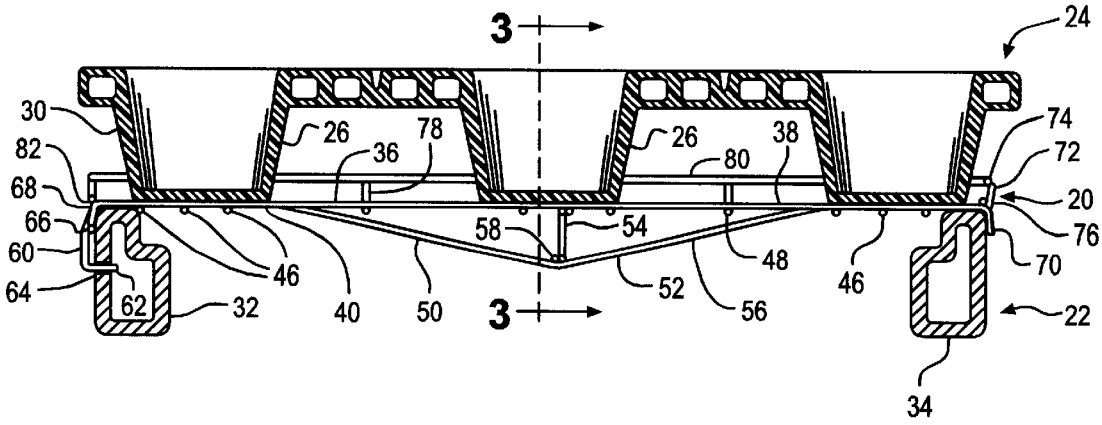
FIG. 2 is a cross-sectional view of the deck of FIG. 1 taken along section line 2—2.
Figure 3:
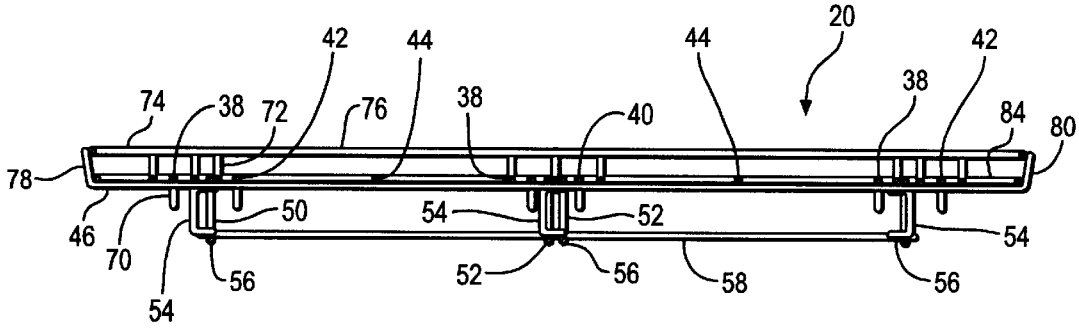
FIG. 3 is a cross-sectional view of the deck of FIG. 1 taken along section line 3—3.
Figure 4:
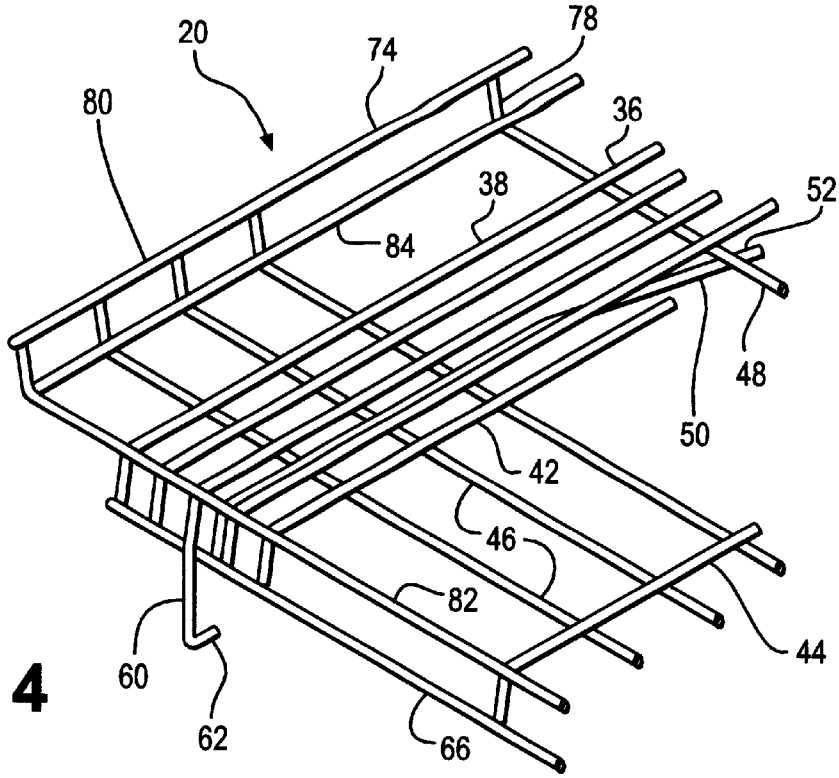
FIG. 4 is an enlarged fragmentary view of a front corner of the deck of FIG. 1.

In addition to having the contact areas configured to the locations of a pallet's legs, the deck 20 has additional features intended to restrict the motion of the deck with respect to the rack 22, and of the supported pallet 24 with respect to the deck. As shown in FIGS. 2 and 4, a hook 60 descends downwardly at the front of the deck adjacent each of the row support segments, and may be formed as an extension of one of the front to back wires 38. Each hook 60 has a rearwardly extending section 62 which may engage beneath a front rack beam, or, as shown in FIG. 2, may extend into a hole 64 drilled in the front beam 32. For the case in which the hook extends beneath a support beam, it may extend downwardly a greater distance than shown in FIG. 1. As pallets are placed on and removed from the deck 20, the tines of a lift truck will come into contact with the deck. From time to time the fork lift tines may engage the deck and work to dislodge it from the rack. The engagement of the hooks 60 with the front beam 32 will prevent the deck 20 from being lifted upwardly.

Figure 5:
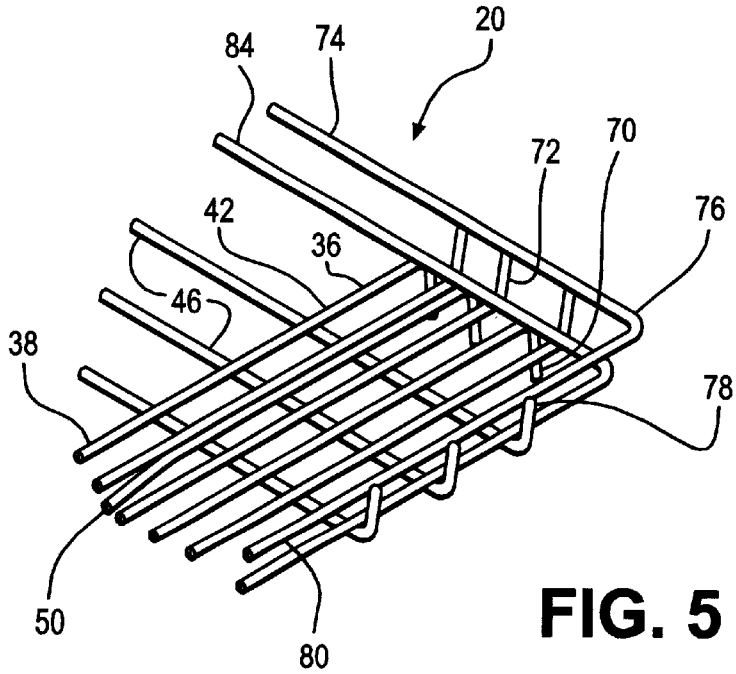
FIG. 5 is an enlarged fragmentary view of a rear corner of the deck of FIG. 1.
Figure 6:
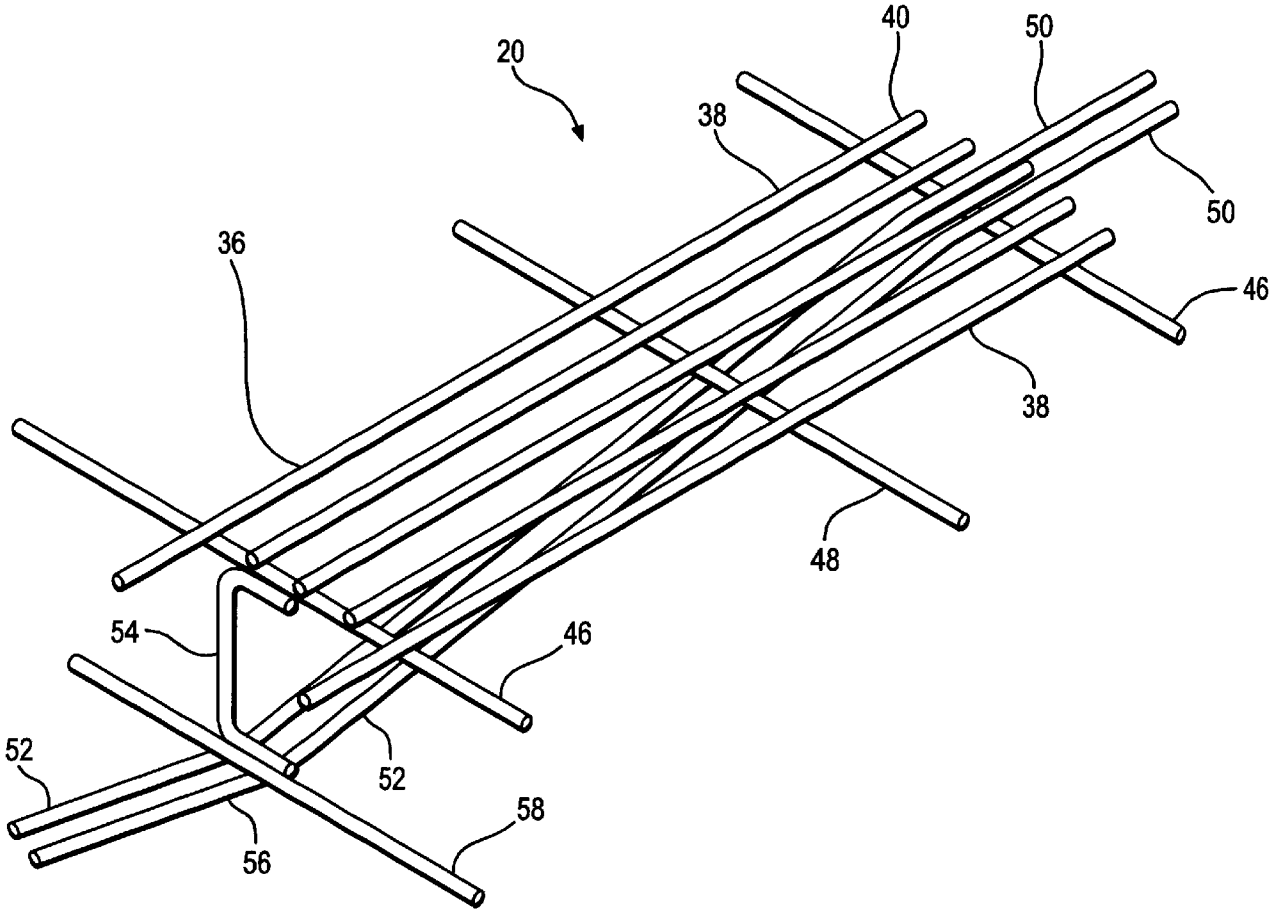
FIG. 6 is an enlarged fragmentary view of a central portion of the deck of FIG. 1.

To prevent the deck 20 from being displaced rearwardly off the rack 22, the front to back wires 38 have downwardly extending sections which are connected by a side to side wire 66 to define a front lip 68 which engages against the rack front beam 32 when the deck is urged rearwardly. In a similar manner, some of the front to back wires 38 have downwardly extending sections or fingers 70 at the rear of the deck, as shown in FIG. 5, which engage with the deck rear beam 34 when the deck is urged frontwardly.

To prevent rearward displacement of the pallet 24 off the deck 20, those front to back wires 38 which do not have downwardly extending fingers 70, have upwardly extending sections 72 which are connected by an elevated side to side wire 74 to define a rear stop 76. It should be noted that although a continuous wire 74 extends across and connects all the upwardly extending wire sections 72, the rear stop 76 could also be formed as three separate rear stops, one for each of the rear pallet legs.

The side to side wires 46 each have an upwardly extending section 78 at each side of the deck, and the rear stop elevated wire 74 forming the top of the rear stop 76 wraps around the sides and is connected to the upwardly extending sections 78 to form side stops 80 on each side of the deck. A peripheral wire 84 extends along the rear and the sides.

Because the front of the deck 20 must be open to permit the loading and removal of pallets, a significantly elevated stop is not provided. However, the racks 22 and the associated decks and pallets can be subjected to external forces, such as minor earth tremors, collisions with lift trucks, and the like which can vibrate the pallets sufficiently to dislodge them from the racks. The deck 20 has a single side to side wire 82 which is connected above the front to back wires 38 at the front edge of the deck. The wire 82 serves as a quake or vibration stop, in that it protrudes upwardly such a small amount, generally less than one quarter inch, that it does not interfere with loading or unloading, but is still enough of a protrusion to prevent the dislodgment of pallets in the event of minor earth tremors, contact of the rack by a forklift, or other external induced shocks or vibrations.

Although the deck has been shown entirely composed of cylindrical wires, in order to reduce the tendency to dent the supported pallet legs, the wires which engage the legs could be square wires or flattened wires. The metal wires may be connected in any appropriate fashion, for example by resistance welding, by spot welding, or by contact welding.

Figure 7:
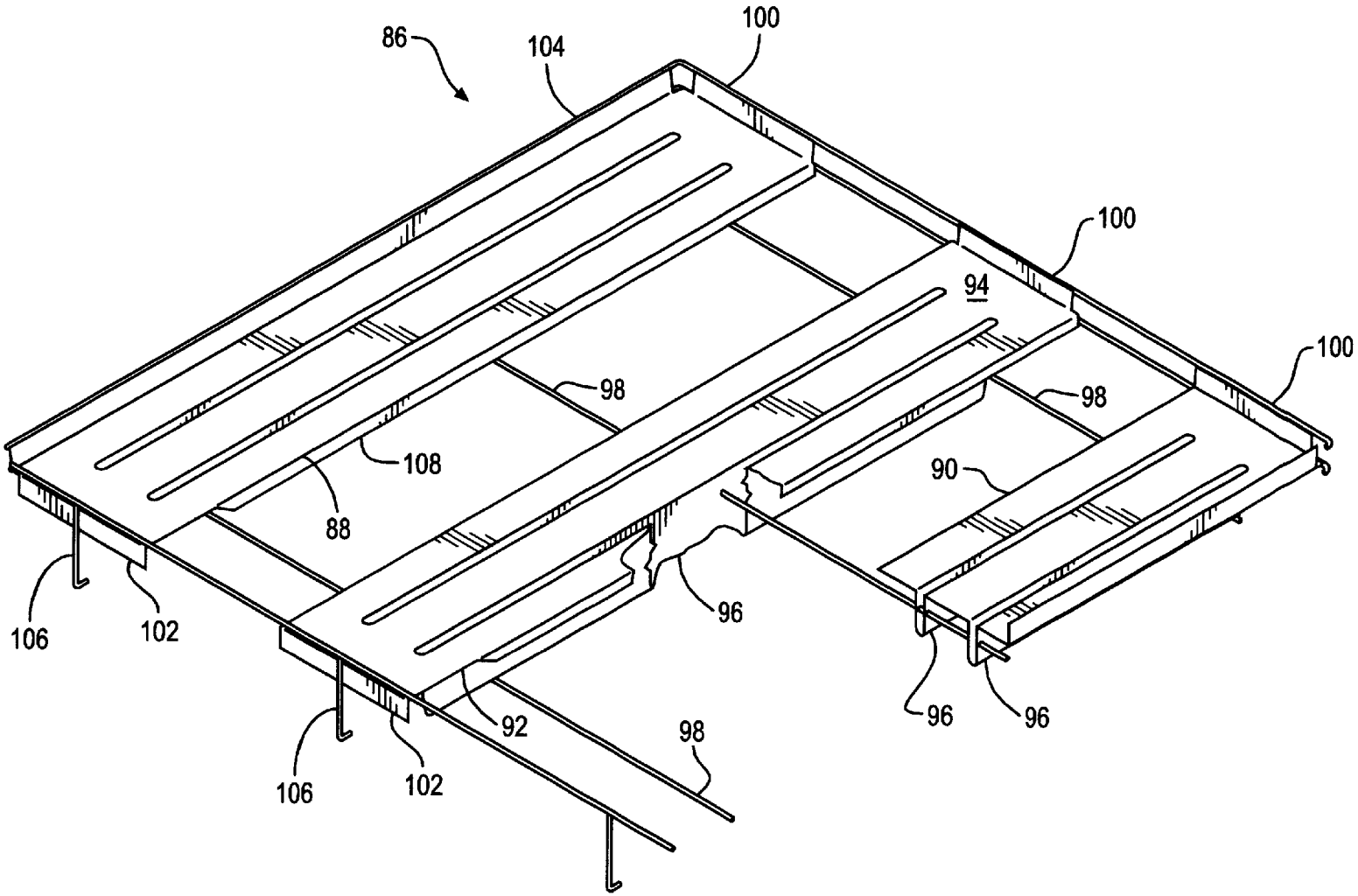
FIG. 7 is an isometric view of an alternative embodiment support deck of this invention.

An alternative embodiment deck 86 is shown in FIG. 7. The deck 86 is similar to the deck 20 discussed above with the difference that the pallet leg row support segments are formed as sheet metal pans instead of as assemblies of wire sections. The deck 86 has a left row support segment 88 and a right row support segment 90 which is a mirror image of the left row support segment. A center row support segment 92 is positioned between the two side support segments 88, 90. Each support segment is formed as a worked sheet of steel either through roll forming, stamping, or other metal working process. Each support segment has a top wall 94 which engages the legs of the pallet, and several ribs 96 which protrude downwardly from the top wall. The ribs 96 may taper or simply terminate at a position spaced from the front and rear beams of the rack. The ribs are preferably formed as two parallel depressions of narrow width, such that a generous contact area between the top wall 94 and a supported pallet leg is provided. For most efficient use of materials, the center support segment 92 should have greater load carrying capacity than either of the two side row support segments 88, 90. This increased stiffness may be obtained in several ways. The vertical depth of the ribs 96 may be increased on the center row support segment 92, as shown in FIG. 7, or the center row support segment 92 may be formed of sheet stock with a greater thickness. Alternatively the center row support segment may have a greater number of downwardly protruding ribs.

The side support segments 88, 90 are connected to the center row support segment 92 by an array of steel wires 98 which extend from side to side and which are affixed to the ribs 96, for example by welding. The wires 98 may be connected to the underside of the ribs 96, or holes may be formed in the sides of the ribs and the wires passed through.

Each row support segment is preferably provided with an upwardly extending rear stop 100, and a downwardly extending front lip 102. The side row support segments 88, 90 have upwardly extending flanges which define side stops 104. Hooks 106 extend downwardly from each of the front lips 102. For greater rigidity, the edges of the row support segments which do not extend upwardly to form a stop have narrow downwardly extending flanges 108.

It should be noted that the deck has a generally open configuration which is desirable for fire safety considerations in that water dispersed through overhead sprinklers will pass through multiple elevations of deck.

It should be further noted that the front to back wires of the deck 20 and the downwardly extending ribs of the deck 86 are rigidifying members which impart stiffness to the pallet leg row support segments, and that other rigidifying members such as tubes, c-channels, corrugated members, or the like may also be employed. Furthermore, although the trusses 56 of the deck 20 impart greater stiffness, in certain applications the stiffness of the front to back wires, without the v-shaped segment wires, may be sufficient, eliminating the need for the trusses.

The decks of this invention provide a capital investment for the pallet rack system owner which will greatly outlast the life of the supported pallets, providing an extended lifetime over which to recover the funds invested. Moreover, while the pallets in a system travel extensively, and may leave the control of the rack system owner, the decks remain in place, where the use, maintenance, and condition can be monitored and controlled by the rack system owner.

It is understood that the invention is not limited to the particular construction and arrangement of parts herein illustrated and described, but embraces such modified forms thereof as come within the scope of the following claims.

I claim:

1. A pallet and support system assembly comprising:

at least one plastic pallet having three rows of legs;

a rigid rack having a horizontally extending front beam and a horizontally extending rear beam spaced rearwardly from the front beam; and a deck removably supported between the rack front beam and the rack rear beam, the deck having two side row support segments and a center row support segment positioned between the two side row support segments, wherein each support segment extends from the front beam to the rear beam, and wherein each support segment is comprised of a plurality of sidewardly spaced front to back wires, and wherein the sideward spacing between the front to back wires within a row support segment is less than the sideward spacing between support segments, the plastic pallet being disposed on the deck such that each row of legs overlies one of the row support segments, and wherein each pallet leg is supported on a plurality of front to back wires.

2. The pallet and support system assembly of claim 1 further comprising a hook which extends downwardly from the front of each row support segment to engage the front beam.

3. The pallet and support system assembly of claim 2 wherein the hooks extend beneath the front beam.

4. The pallet and support system assembly of claim 2 wherein portions of the front beam define a rearwardly extending hole corresponding to each hook, and wherein the hooks extend into the holes.

5. The pallet and support system assembly of claim 1 wherein at least one of the front to back wires of the center and side row support segments have portions which extend below a deck top surface in a v-shape.

6. The pallet support deck of claim 5 wherein the v-shape portions of the center row support segment and the side row support segments are connected by at least one side to side wire.

7. The pallet and support system assembly of claim 1 further comprising portions which extend upwardly from the rear of each row support segment to define a rear stop positioned to engage the leg of a pallet positioned on the deck and to restrict the rearward exit of the pallet from the deck.

8. The pallet and support system assembly of claim 1 further comprising portions which extend downwardly from the front of each row support segment to define a rim which engages the rack front beam to restrict rearward travel of the deck with respect to the rack.

9. The pallet and support system assembly of claim 1 further comprising portions which extend downwardly from the rear of each row support segment to define a rear rim which engages the rack rear beam to restrict frontward travel of the deck with respect to the rack.

10. The pallet and support system assembly of claim 1 further comprising portions which extend upwardly from the side row support segments to define side stops which restrict the sideward travel of the pallet positioned on the deck.

11. The pallet and support system assembly of claim 1 wherein the center row segment has two front to back wires which extend downwardly from a deck upper surface, and the side row segments have a single front to back wire which extends downwardly from the deck upper surface, such that the stiffness of the center row support segment is greater than the stiffness of either of the side row support segments, such that the center row support segment is capable of supporting a greater load than either of the side row support segments.

12. A pallet support deck for attachment between a front beam and a rear beam of a rack, the deck comprising:

a first side row support segment;

a second side row support segment; and a center row support segment positioned between the first side row support segment and the second side row support segment, wherein each support segment extending in a front to back direction and comprised of a plurality of sidewardly spaced front to back wires in which the sideward spacing between the wires within a row support segment is less than the sideward spacing between support segments, the deck having a top surface defined by a plurality of generally parallel front to back wires, including the front to back wires of the row support segments, the row support segments being positioned to support the loads imposed by a pallet thereon, wherein a plurality of the front to back wires forming each row support segment have portions at the rear of the deck which extend upwardly to define a rear stop to restrict rearward displacement of a supported pallet with respect to the deck, and wherein at least one of the front to back wires defining row support segment has portions which extend downwardly below the center of the deck, and a member extends vertically between another front to back wire and the downwardly extending portions to define a truss.

13. The pallet support deck of claim 12 wherein at least one of the front to back wires of the center and side row support segments have portions which extend below the deck top surface, and wherein a greater amount of material extends beneath the center row support segment, such that the stiffness of the center row support segment is greater than the stiffness of either of the side row support segments.

14. A pallet support deck for attachment between a front beam and a rear beam of a rack, the deck comprising:

a first side row support segment, comprised of a plurality of front to back extending wires;

a center row support segment, comprised of a plurality of front to back extending wires; and a second side row support segment, comprised of a plurality of front to back extending wires, wherein each row support segment extends from front to back, and wherein the row support segments are connected by sidewardly extending elements, and wherein each row support segment forms a part of a deck top surface, the row support segments providing concentrated support for the rows of legs of a pallet, and wherein each row support segment has upwardly bent wire portions which extend upwardly at the rear of the deck to engage a supported pallet and restrict the rearward displacement of a supported pallet, and wherein each row support segment has downwardly bent wire portions which extend downwardly at the rear of the deck to engage the underlying rear beam of the rack and restrict the forward displacement of the deck with respect to the rack.

15. The pallet support deck of claim 14 further comprising portions which extend upwardly on the left side and the right side of the deck, to restrict sideward displacement of a pallet supported on the deck.

16. The pallet support deck of claim 14 further comprising at least one hook which extends downwardly from the front of a row support segment, the hook having portions which extend rearwardly to engage the rack front beam.

* * * * *